US006974090B2

(12) United States Patent
Brax

(10) Patent No.: US 6,974,090 B2
(45) Date of Patent: Dec. 13, 2005

(54) ADJUSTABLE DISPENSER TIP

(76) Inventor: Harold J. Brax, 255 Southwick, Schaumburg, IL (US) 60173

( * ) Notice: Subject to any disclaimer, the term of this patent is extended or adjusted under 35 U.S.C. 154(b) by 96 days.

(21) Appl. No.: 10/663,946

(22) Filed: Sep. 16, 2003

(65) Prior Publication Data

US 2004/0135008 A1 Jul. 15, 2004

Related U.S. Application Data

(60) Provisional application No. 60/411,044, filed on Sep. 16, 2002.

(51) Int. Cl.[7] ..... B05B 15/02; F23D 11/34; F23D 11/38; F23D 14/50

(52) U.S. Cl. ..... 239/107; 239/493; 239/104; 222/502; 222/503; 222/507; 222/509; 222/522

(58) Field of Search ..... 239/493, 107; 222/502, 503, 507, 509, 522

(56) References Cited

U.S. PATENT DOCUMENTS 68,712 A 9/1867 Crook
690,754 A * 1/1902 McKechney ..... 239/546
2,901,152 A * 8/1959 Wahnsiedler ..... 222/502
2,953,248 A * 9/1960 Troland ..... 210/251
4,204,328 A * 5/1980 Kutner ..... 433/29
4,546,906 A * 10/1985 Vadnais ..... 222/502
5,743,668 A * 4/1998 Zimmerman ..... 401/265
6,299,034 B1 * 10/2001 Tancheff ..... 222/502

* cited by examiner

*Primary Examiner*—David A. Scherbel
*Assistant Examiner*—James S. Hogan
(74) *Attorney, Agent, or Firm*—Pauley Petersen & Erickson

(57) ABSTRACT

An adjustable dispenser tip including a nozzle forming a passage along a length of the nozzle. A plurality of independently movable, flexible fingers define an orifice at a dispensing end portion of the nozzle. A coupler is positioned about at least a portion of the nozzle and movable with respect to the nozzle to contact and urge the fingers to adjust an area of the orifice. An elastomeric web is positioned with respect to the nozzle and connects adjacent fingers. The elastomeric web can be positioned on an outer surface of the nozzle, an inside surface of the nozzle, or between adjacent fingers, for example.

21 Claims, 5 Drawing Sheets

ADJUSTABLE DISPENSER TIP

CROSS REFERENCE TO RELATED APPLICATION

This application claims the benefit of U.S. Provisional Application No. 60/411,044, filed Sep. 16, 2002.

BACKGROUND OF THE INVENTION

1. Field of the Invention

This invention relates to an adjustable dispenser tip wherein a material output or flow from a container, such as a tube of caulk, may be controlled and/or adjusted using a pair of cooperating members and an elastomeric web.

2. Description of Prior Art

Many conventional dispenser tips typically include a nozzle forming a passage for dispensing a material from an attached or connected container. The nozzle can be cut at a location along a length of the nozzle corresponding to a desired passage diameter. The material is dispensed from the dispenser tip at the cut location and applied to a desired working surface or location. Once the nozzle is cut, the passage diameter cannot be controlled and/or adjusted. Thus, the distribution size or amount of material dispensed from the dispenser tip cannot be controlled and/or adjusted, which may result in undesirable leakage or material overflow during dispensing and/or application of the material.

Other conventional nozzles or dispenser tips are typically connected to an end portion of the container or tube and provide a fixed orifice through which the material is dispensed. Such conventional nozzles and dispenser tips do not provide options for the user to control and/or adjust the distribution size and/or the amount of material dispensed.

Therefore, there exists a need for a dispenser tip having an orifice in fluidic communication with a nozzle passage that is adjustable in order to control and/or adjust the output flow of material from a container to which the dispenser tip is connected or attached.

SUMMARY OF THE INVENTION

It is one object of this invention to provide a dispenser tip that controls and/or adjusts the output dispensing flow of material.

It is another object of this invention to provide an adjustable dispenser tip having a collar arrangement for controlling and/or adjusting the output dispensing flow of material.

It is another object of this invention to provide an adjustable dispenser tip having an orifice through which the material is dispensed having an area that is adjustable as desired.

An adjustable dispenser tip according to this invention preferably is integrated with a material container or tube. For example, the adjustable tip dispenser can be integrated with the material container or tube during the manufacturing process. Alternatively, the adjustable dispenser tip may be an independent component that can be attached or connected to the material container or tube after the manufacturing process, to dispense the material. The adjustable dispenser tip according to this invention can be integrated with, or connected or attached to any suitable commercial material container or tube, such as a caulk tube, a glue bottle or tube, or a decorating frosting container. The adjustable dispenser tip according to this invention includes a nozzle which forms a passage along a length of the nozzle. The nozzle has a mating end portion and a dispensing end portion at opposing end portions of the passage. At the dispensing end portion, a plurality of independently movable fingers define or form an orifice in fluidic communication with the passage. The nozzle is preferably formed of at least one of a metal, an alloy, a plastic, a graphite material, a metal composite material, a non-metal composite material and combinations thereof.

The adjustable dispenser tip further includes a coupler that is positioned with respect to the nozzle and movable with respect to the nozzle to adjust an area of the orifice. Preferably, the coupler is positioned about at least a portion of the nozzle and movable with respect to the nozzle to urge the fingers to adjust the orifice area. According to one preferred embodiment of this invention, the coupler is threadedly attached or engaged at a base end portion to a plurality of threads on an outer surface of the nozzle mating end portion and rotatable about the nozzle to traverse a length of the nozzle. Alternatively, the coupler may be slidably movable along the nozzle to contact and urge the fingers to adjust the orifice area.

According to one preferred embodiment of this invention, the adjustable dispenser tip includes a collar arrangement wherein at least a portion of the nozzle dispensing end portion is tapered and a corresponding portion of a tip end portion of the coupler is tapered. Preferably, the collar arrangement is positioned with respect to an outer surface of the nozzle. The tapered coupler tip end portion contacts the flexible fingers and independently urges each flexible finger to adjust the orifice area. The coupler is rotatable with respect to the nozzle so that the coupler moves or traverses a length of the nozzle. As the coupler traverses the nozzle length, the tapered tip end portion contacts each flexible finger at the dispensing end portion to independently urge each finger and adjust the orifice area. For example, when the coupler is rotated in a counterclockwise direction, the coupler traverses the nozzle length in a direction towards the dispensing end portion. As a result, the fingers expand or move outwardly to increase the orifice area. Conversely, when the coupler is rotated in a clockwise direction, the coupler traverses the nozzle length in a direction towards the mating end portion. As a result, the tapered tip end portion applies a pressure or force to each finger at the tapered dispensing end portion to urge each finger inwardly to decrease the orifice area.

The adjustable dispenser tip further includes an elastomeric web positioned with respect to the nozzle and connecting the fingers. Preferably, the elastomeric web has material memory so that the elastomeric web returns to its original or initial shape after removal of a force which causes the elastomeric web to stretch or deform. Further, the elastomeric web preferably is generally nonporous and impermeable to flowable materials. Suitable materials for the elastomeric web include, but are not limited to, elastic materials, elastomeric materials, silicone materials, latex materials, thermoplastic elastomers and rubber materials. The elastomeric web can be positioned on or connected to an outer surface of the nozzle, an inner surface of the nozzle or between each of the independently movable fingers. According to one preferred embodiment of this invention, the elastomeric web includes a plurality of web sections which are integrally formed with the nozzle and attach or connect adjacent fingers to cover each gap or area between adjacent fingers. Alternatively, the elastomeric web may include at least one membrane that is positioned about the dispensing end portion and covers each finger, as well as the gaps or areas between adjacent fingers. According to one preferred embodiment of this invention, the elastomeric web includes at least one membrane that is positioned between the nozzle and the coupler and covers the flexible fingers.

BRIEF DESCRIPTION OF THE DRAWINGS

The above-mentioned and other features and objects of this invention will be better understood from the following detailed description taken in conjunction with the drawings wherein.

DETAILED DESCRIPTION OF PREFERRED EMBODIMENTS

Figure 1:
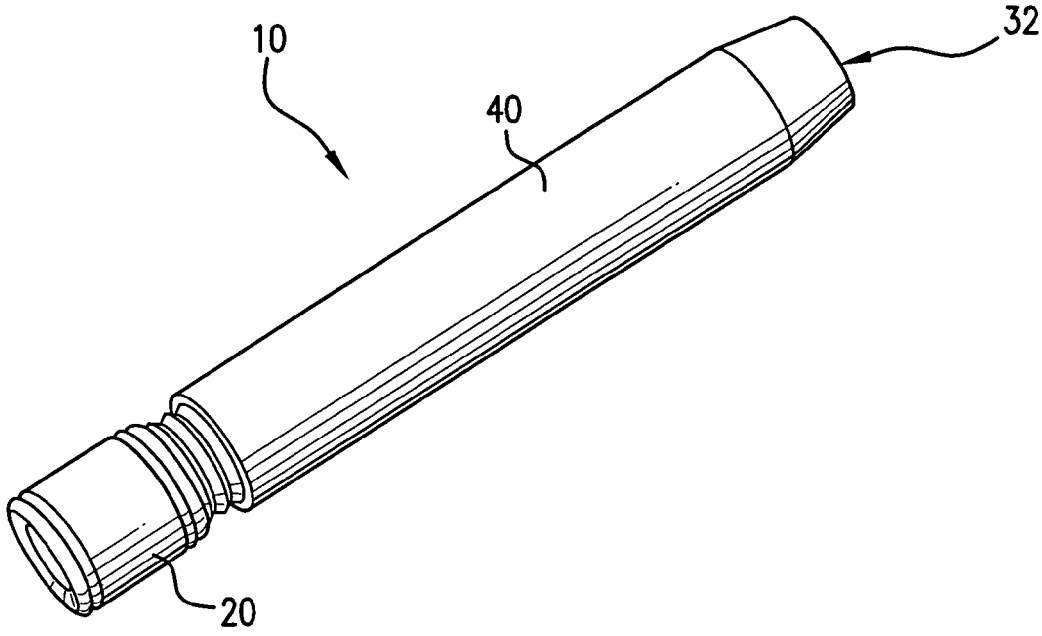
FIG. 1 is a perspective view of an adjustable dispenser tip, according to one preferred embodiment of this invention.
Figure 2:
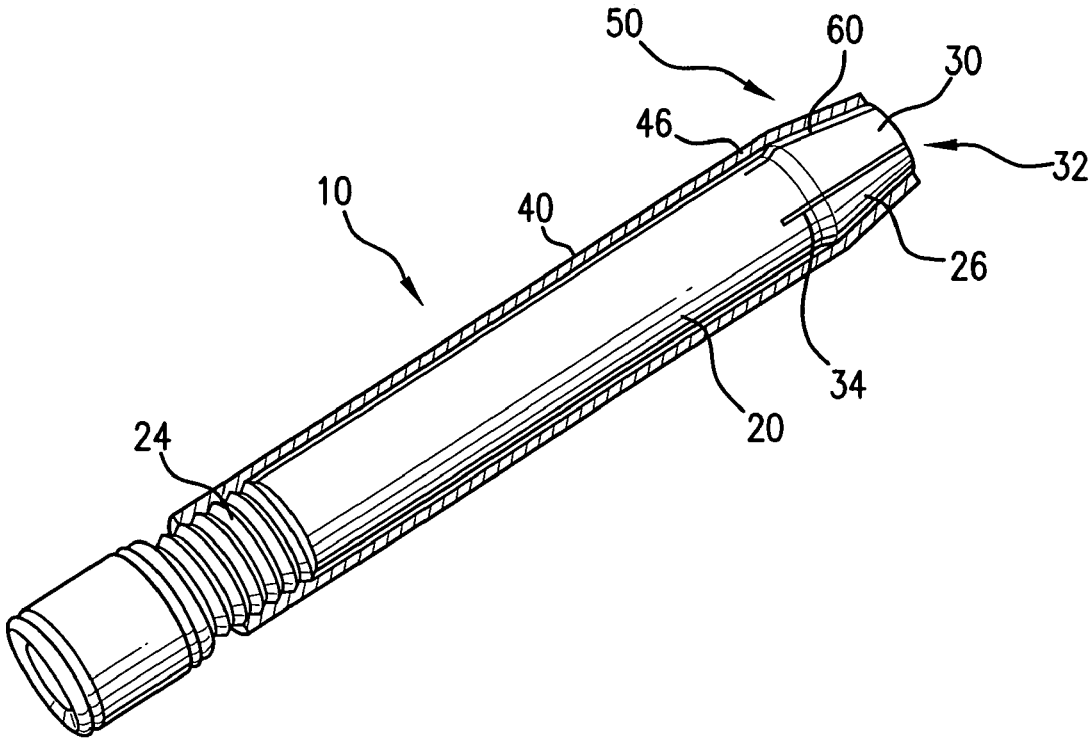
FIG. 2 is a perspective view of an adjustable dispenser tip in partial cross-section, according to one preferred embodiment of this invention.
Figure 3:
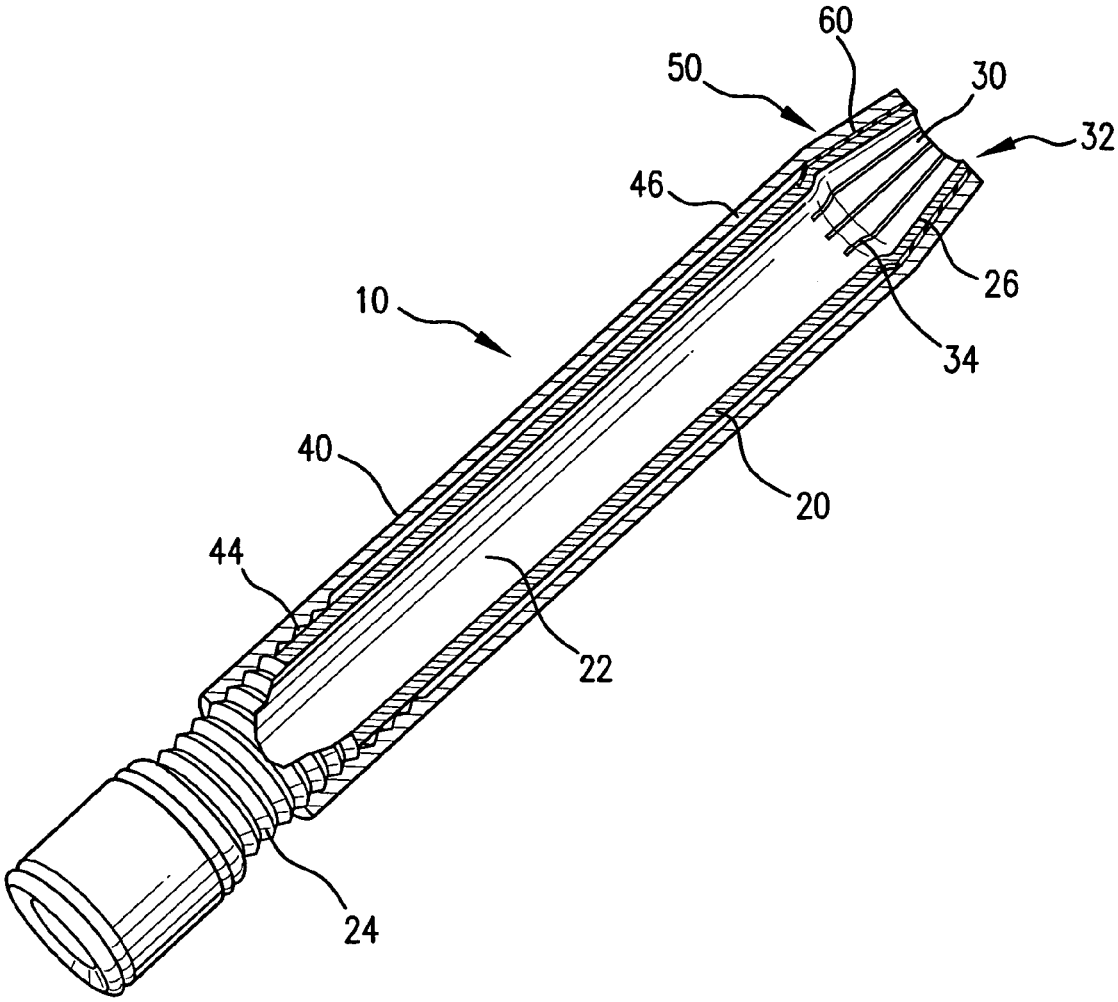
FIG. 3 is a perspective view of an adjustable dispenser tip in cross-section, according to one preferred embodiment of this invention.

FIGS. 1–3 show an adjustable dispenser tip 10 according to one preferred embodiment of this invention, comprising a nozzle 20 forming a passage 22 along a length of nozzle 20. Preferably, but not necessarily, passage 22 has a cylindrical shape with a circular cross-sectional area. It should be apparent that passage 22 may have any suitable or desired shape and/or cross-sectional area. According to one embodiment of this invention, passage 22 has a conical shape wherein a cross-sectional area of passage 22 at a mating end portion 24 is larger than a cross-sectional area of passage 22 at a dispensing end portion 26. Adjustable dispenser tip 10 is adapted to be connected or attached to a container, such as a tube of caulk or adhesive material, to dispense and/or apply the material to a desired working area. Alternatively, adjustable dispenser tip 10 can be formed as an integral part or element of the container. Nozzle 20 comprises any suitable material known to those having ordinary skill in the art and guided by the teachings herein provided, such as a metal, an alloy, a plastic, a graphite material, a metal composite material, anon-metal composite material and combinations thereof. As shown in FIGS. 2 and 3, mating end portion 24 comprises threads on an outer surface of mating end portion 24. At least a portion of dispensing end portion 26 is preferably tapered to form a nozzle tip.

Referring to FIGS. 2 and 3, nozzle 20 comprises a plurality of independently movable fingers 30 which define or form an orifice 32 at dispensing end portion 26. Orifice 32 is in fluidic communication with passage 22. Each finger 30 is preferably made of a flexible material having a material memory. The term material memory as used throughout this specification refers to an ability of a material to return to its original or initial shape or configuration after a force which deforms, moves or urges the material toward a second position or configuration is removed. Suitable materials for fingers 30 include, but are not limited to, those materials discussed above in reference to nozzle 20. Preferably, fingers 30 are formed of the same or similar material as a base portion of nozzle 20. Any number of fingers 30 may be formed at dispensing end portion 26, depending upon the required size, strength and/or flexibility of adjustable dispenser tip 10. Further, each finger 30 may have any suitable length, width and/or thickness to facilitate the attachment and/or integration of an elastomeric web, discussed below, to an outer surface of fingers 30, an inner surface of fingers 30 or areas between adjacent fingers 30.

According to one preferred embodiment of this invention, four arcuate-shaped segmented fingers 30 form orifice 32 at dispensing end portion 26, as shown in FIGS. 2 and 3. Adjacent fingers 30 are separated by a small gap or space 34 to allow each finger 30 to move or flex independently, without interference from other fingers 30. As shown for example in FIG. 2, each gap 34 extends along at least a portion of dispensing end portion 26. Gap 34 may extend any suitable length and width with respect to dispensing end portion 26 to allow movement of each finger 30 in order to adjust an area of orifice 32, as further discussed below.

Figure 4:
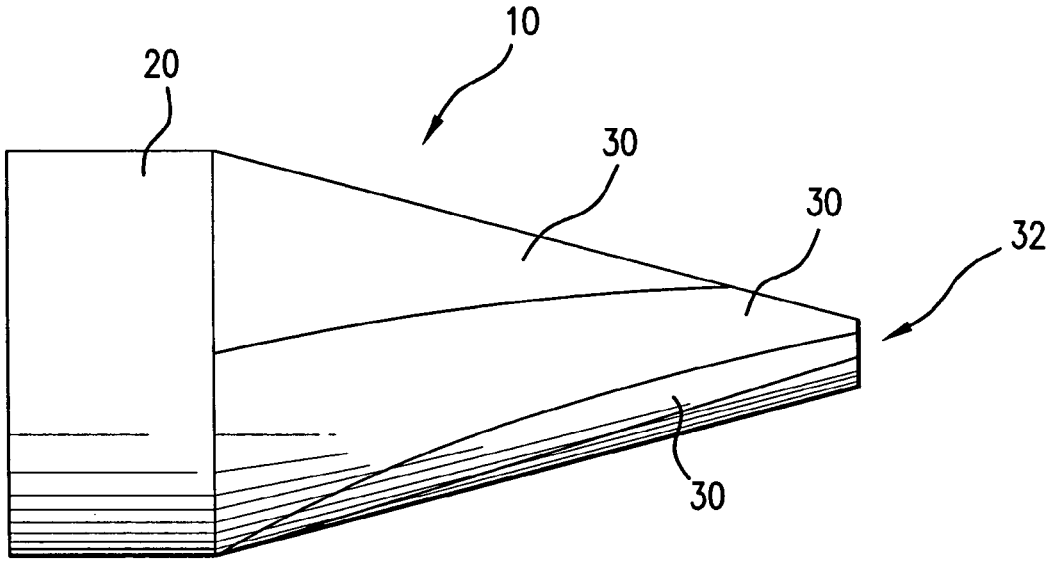
FIG. 4 is a front view of an adjustable dispenser tip, according to one preferred embodiment of this invention.
Figure 5:
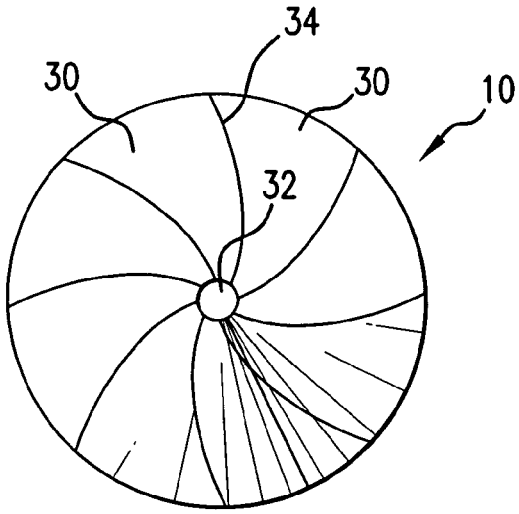
FIG. 5 is a side view of an adjustable dispenser tip according to one preferred embodiment of this invention.

According to an alternative preferred embodiment of this invention as shown in FIGS. 4 and 5, fingers 30 are interlaced and/or overlapping. In such an arrangement, adjacent fingers 30 overlap each other, are interwoven with each other or are otherwise arranged so that adjacent fingers 30 are at least partially touching, even when orifice 32 is in an expanded or partially expanded position. As such, relative movement of adjacent fingers 30 is partially dependent upon the movement of each other adjacent finger 30. Additionally, such an arrangement minimizes gaps 34 between adjacent fingers 30. Such an overlapping arrangement may be a unitary arrangement or may involve a conical member having multiple, overlapping fingers 30 attached toward a base end and tapering toward orifice 32. In each preferred embodiment of this invention, adjustable dispenser tip 10 comprises an elastomeric web that is positioned with respect to nozzle 20 to connect adjacent fingers 30, as discussed further below. The elastomeric web can be integrally formed or positioned on an outer surface of nozzle 20, an inner surface of nozzle 20, or between adjacent fingers 30, and allows each finger 30 to move outwardly or inwardly with respect to nozzle 20 while preventing the material contained within passage 22 from exiting or dispensing through gaps 34 between adjacent fingers 30.

Adjustable dispenser tip 10 further comprises a coupler 40 positioned with respect to nozzle 20. Preferably, coupler 40 is positioned about at least a portion of nozzle 20, as shown in FIG. 1 for example. Coupler 40 is movable with respect to nozzle 20 to urge fingers 30 and adjust the orifice area. According to one preferred embodiment of this invention, coupler 40 comprises a base end portion 44 having internal threads to threadedly connect or engage coupler 40 to nozzle 20 at mating end portion 24. The threaded connection or engagement allows coupler 40 to rotate with respect to nozzle 20 to traverse a length of nozzle 20. It is apparent to those skilled in the art and guided by the teachings herein provided, that other suitable connections may be used to connect coupler 40 to nozzle 20 which allows movement of coupler 40 with respect to the nozzle length. For example, in an alternative preferred embodiment of this invention, coupler 40 is slidably connected to nozzle 20 to allow coupler 40 to slidably move along at least a portion of the nozzle length to control and/or adjust the orifice area.

As shown in FIGS. 2 and 3, adjustable dispenser tip 10 includes a collar arrangement 50 at dispensing end portion 26, which allows for adjustment of the orifice area. Such an arrangement permits adjustment of the orifice area to control the distribution size and/or amount of material dispensed from adjustable dispenser tip 10. Collar arrangement 50 comprises a tapered tip end portion 46 of coupler 40 that is positioned about and cooperative with tapered dispensing end portion 26. Preferably, the degree of taper of tip end portion 46 generally corresponds to the degree of taper of dispensing end portion 26, as shown in FIGS. 2 and 3.

Referring further to FIGS. 2 and 3, coupler 40 is rotatable with respect to nozzle 20 so that coupler 40 moves or traverses nozzle 20 along the nozzle length. The nozzle length generally runs along a longitudinal axis of nozzle 20. As coupler 40 traverses the nozzle length, tapered tip end portion 46 contacts each finger 30 at dispensing end portion 26 to independently urge each finger 30 and adjust the orifice area. For example, when coupler 40 is rotated in a counter-clockwise direction, coupler 40 traverses the nozzle length in a direction towards dispensing end portion 26. As a result, a contact pressure urging fingers 30 inwardly toward a center point of orifice 32 is at least partially released to allow each finger 30 to expand or move outwardly with respect to the orifice center point to increase the orifice area. Conversely, when coupler 40 is rotated in a clockwise direction coupler 40 traverses the nozzle length in a direction towards mating end portion 24. As a result, tapered tip end portion 46 applies a contact pressure or force to each finger 30 at tapered dispensing end portion 26 to urge each finger 30 inwardly toward the orifice center point and decrease the orifice area.

Figure 6:
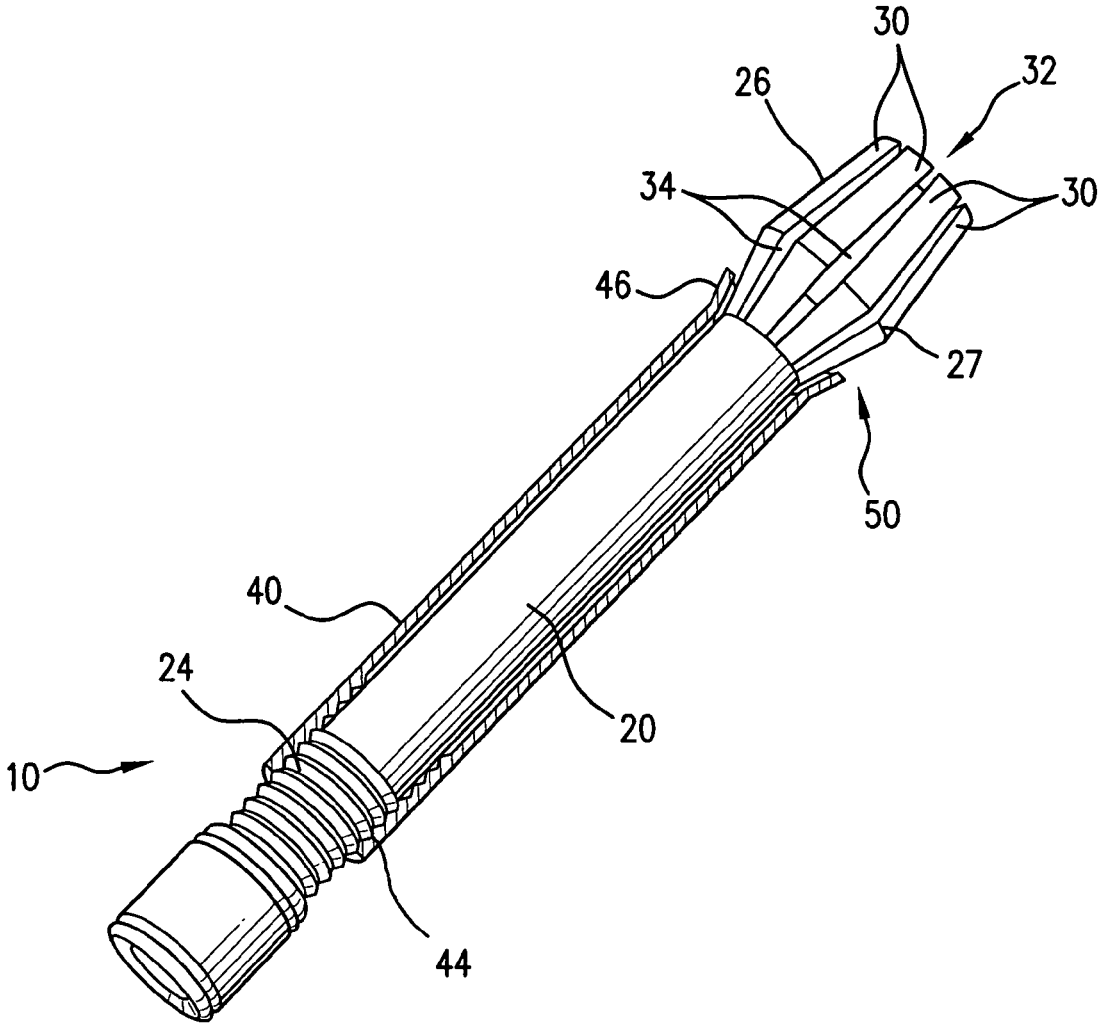
FIG. 6 is a side view in partial cross-section of an adjustable dispenser tip having an outwardly tapered tip end portion, according to one preferred embodiment of this invention.

According to an alternative preferred embodiment of this invention, collar arrangement 50 comprises an arrangement wherein nozzle dispensing end portion 26 is double tapered. Tapered tip end portion 46 of coupler 40 is positioned about dispensing end portion 26, and tapers in an outward direction with respect to nozzle 20, as shown in FIG. 6. Coupler 40 is movable with respect to nozzle 20 to urge fingers 30 and adjust the orifice area. Preferably, coupler base end portion 44 includes internal threads to threadedly connect or engage coupler 40 to nozzle 20 at mating end portion 24. As coupler 40 is rotated with respect to nozzle 20, coupler 40 traverses a length of nozzle 20, and contacts flexible fingers 30. Flexible fingers 30 move or flex in response to the contact with coupler 40 to control and/or adjust the orifice area. Nozzle dispensing end portion 26 is double tapered so that as flexible fingers 30 move in response to contact with coupler 40, a midsection 27 of dispensing end portion 26 expands or contracts with respect to the longitudinal axis of nozzle 20.

According to one preferred embodiment of this invention, adjustable dispenser tip 10 comprises an elastomeric web 60 positioned with respect to nozzle 20 to connect adjacent fingers 30. Elastomeric web 60 has material memory so that the elastomeric web returns to its original or initial shape after removal of a force which causes elastomeric web 60 to stretch or deform. Further, elastomeric web 60 is preferably generally nonporous and impermeable to flowable materials. Suitable materials for elastomeric web 60 include, but are not limited to, elastic materials, elastomeric materials, silicone materials, latex materials, thermoplastic elastomers and rubber materials. As used throughout this description, the term "elastic" refers to a material or composite which recovers its original size and shape after removal of a force causing a deformation, and the term "elastomeric" refers to a material or composite which can be elongated by at least 50 percent of its relaxed length and which will recover, upon release of the applied force, at least 40 percent of its elongation. It is generally preferred that the elastomeric material or composite be capable of being elongated by at least 100 percent, more preferably by at least 300 percent, of its relaxed length and recover, upon release of an applied force, at least 50 percent of its elongation. It is apparent to those having ordinary skill in the art and guided by the teachings herein provided that web 60 may comprise other suitable materials. Elastomeric web 60 allows each finger 30 to move outwardly or inwardly in response to movement of coupler 40 with respect to nozzle 20 while preventing the material contained within passage 22 from exiting or dispensing through gaps 34 between adjacent fingers 30 as the material is dispensed from orifice 32.

According to one preferred embodiment of this invention, elastomeric web 60 comprises at least one membrane that is positionable with respect to dispensing end portion 26 and between each independently movable finger 30 to cover gaps 34 between adjacent fingers 30 and connect adjacent fingers 30. Elastomeric web 60 can comprise any number of suitable membranes depending upon the size of adjustable dispensing tip 10 and the required web flexibility and thickness. According to one preferred embodiment of this invention, elastomeric web 60 comprises a membrane that is positioned between two layers of nozzle 20 and thereby between flexible fingers 30. Specifically, two generally coextensive layers of material form nozzle 20 and are sandwiched around elastomeric web 60 to join each flexible finger 30. Elastomeric web 60 can be integrally formed or positioned on an outer surface of nozzle 20, an inner surface of nozzle 20, or between adjacent fingers 30, using a suitable manufacturing process including, but not limited to, adhesive bonding, heat bonding, liquid latex bonding, two-shot injection molding, overmolding, multimaterial molding and any other suitable attachment or integration process known to those having ordinary skill in the art. In an alternative preferred embodiment of this invention, elastomeric web 60 is segmented to comprise a plurality of web sections or pieces which are integrated with or connected to or between adjacent fingers 30 and cover each gap 34 formed between adjacent fingers 30. In addition, elastomeric web 60 may be interwoven directly with adjacent fingers 30 to cover each gap 34 formed between adjacent fingers 30. Elastomeric web 60 can be formed integrally with nozzle 20 using a suitable molding process or method, for example.

One aspect of the manufacturability of adjustable dispenser tip 10 of the present invention is the attachment, integration or joining of elastomeric web 60 with nozzle 20. Preferred molding processes for the manufacture of adjustable dispenser tip 10 include a two-shot injection molding, wherein two materials are injected separately into the same mold, and an overmolding process, wherein one material is molded or fused onto a second material. Other suitable manufacturing processes, such as multimaterial injection molding, may also be used to manufacture adjustable dispenser tip 10. Regardless of the molding process chosen for manufacturing adjustable dispenser tip 10, the attachment, integration or joining of elastomeric web 60 and nozzle 20 allows the output flow of dispensing material to be controlled and/or adjusted by adjusting the orifice area defined or formed by independently movable fingers 30.

Thus, this invention provides an adjustable dispenser tip having a collar arrangement wherein a coupler tip end portion is movable with respect to a nozzle dispensing end portion to urge or move a plurality of fingers at the dispensing end portion in order to control and/or adjust an orifice area formed or defined by the fingers. As the coupler moves with respect to the nozzle, the fingers either move outwardly to increase the orifice area or are urged inwardly to decrease the orifice area, depending upon the direction of movement of the coupler with respect to the nozzle. According to one preferred embodiment of this invention, the coupler is threadedly engaged with the nozzle, and rotation of the coupler with respect to the nozzle causes the coupler to traverse a length of the nozzle whereby the orifice area can be controlled and/or adjusted. An elastomeric web is positioned with respect to the nozzle to connect adjacent fingers. The interaction between elastomeric web 60 and fingers 30 allows each finger to move outwardly or inwardly in response to movement of the coupler with respect to the nozzle while preventing material from exiting or dispensing through gaps otherwise formed between adjacent fingers.

It is apparent from the teachings herein provided that the adjustable dispenser tip according to the present invention is suitable for many applications. The adjustable dispenser tip according to this invention can be integrated with, or connected or attached to any suitable commercial material container or tube, such as a caulk tube, a glue bottle or tube, or a decorating frosting container. Further, the adjustable dispenser tip may have any suitable cross-sectional shape, such as a circular shape, a triangular shape, a rectangular shape or a star shape.

An additional benefit of the subject invention is the cooperation of flexible fingers 30 and elastomeric web 60 that permits the user to easily remove any excess or dried material that accumulates about orifice 32. As such, dispenser tip 10 may not require any additional caps or covers to prevent material in tip from drying, hardening and obstructing nozzle 20 because such material may be easily removed before use.

Preferably, but not necessarily, the adjustable dispenser tip is integrated or attached with a material container or tube during the container or tube manufacturing process. Alternatively, the adjustable dispenser tip may be an independent component that can be attached or connected to the material container or tube after the manufacturing process, to dispense the material. For example, the adjustable dispenser tip may include inner threads at the mating end portion to threadedly connect or engage the adjustable dispenser tip with a caulk tube.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

I claim:

1. An adjustable dispenser tip comprising:

a nozzle forming a passage along a length of the nozzle, the nozzle having a mating end portion and a dispensing end portion;

a plurality of independently movable fingers defining an orifice at the dispensing end portion in communication with the passage;

a coupler positioned with respect to the nozzle and movable with respect to the nozzle urging the fingers to adjust an area of the orifice; and an elastomeric web positioned with respect to the nozzle, the elastomeric web positioned between each of the independently movable fingers and connecting the fingers.

2. The adjustable dispenser tip of claim 1 wherein the elastomeric web is positioned on an outer surface of the nozzle.

3. The adjustable dispenser tip of claim 1 wherein the elastomeric web is positioned inside the nozzle.

4. The adjustable dispenser tip of claim 1 wherein the coupler comprises an internally threaded base end portion threadedly engageable with a plurality of threads on an outer surface of the nozzle mating end portion.

5. The adjustable dispenser tip of claim 1 wherein the coupler is threadedly connected to the nozzle and rotatable about the nozzle to traverse a length of the nozzle.

6. The adjustable dispenser tip of claim 1 wherein the nozzle dispensing end portion is tapered.

7. The adjustable dispenser tip of claim 6 wherein the coupler comprises a tapered tip end portion that contacts the fingers and urges each finger to adjust the area of the orifice.

8. The adjustable dispenser tip of claim 1 wherein the coupler is slidably movable along the nozzle to contact and urge the fingers to adjust the area of the orifice.

9. The adjustable dispenser tip of claim 1 further comprising a collar arrangement wherein at least a portion of a tip end portion of the coupler is tapered corresponding to at least a portion of a tapered dispensing end portion of the nozzle, the coupler rotatable with respect to the nozzle to move the coupler with respect to a length of the nozzle, contacting and urging each finger in a direction with respect to a center point of the orifice.

10. An adjustable dispenser tip comprising:

a nozzle forming a passage between a threaded mating end portion and a dispensing end portion, the dispensing end portion having a plurality of flexible fingers defining an orifice at an end of the passage;

a coupler threadedly connected at a base end portion to the nozzle mating end portion, the coupler rotatable about said nozzle to traverse a length of the nozzle and urge the flexible fingers to adjust an area of the orifice; and an elastomeric web positioned with respect to the nozzle and connecting adjacent flexible fingers, the elastomeric web including a membrane positioned between the nozzle and the coupler, and covering the plurality of flexible fingers.

11. The adjustable dispenser tip of claim 10 wherein at least a portion of the nozzle dispensing end portion is tapered.

12. The adjustable dispenser tip of claim 11 wherein at least a portion of a tip end portion of the coupler is tapered.

13. The adjustable dispenser tip of claim 12 wherein the tip end portion contacts the flexible fingers to independently urge the flexible fingers.

14. The adjustable dispenser tip of claim 10 wherein the nozzle comprises at least one of a metal, an alloy, a plastic, a graphite material, a metal composite material, a non-metal composite material and combinations thereof.

15. The adjustable dispenser tip of claim 10 wherein the elastomeric web comprises one of an elastic material, an elastomeric material, a silicone material, a latex material and a rubber material.

16. An adjustable dispenser tip comprising:

a nozzle forming a passage and having a plurality of fingers forming an orifice at a tapered dispensing end portion of the nozzle, the fingers independently movable to adjust an area of the orifice;

a coupler positioned about at least a portion of the nozzle and having a tapered tip end portion contacting the tapered dispensing end portion of the nozzle, the coupler movable with respect to the nozzle to urge the fingers to adjust the area of the orifice; and an elastomeric web positioned on an outer surface of the nozzle and connecting adjacent fingers.

17. The adjustable dispenser tip of claim 16 wherein the elastomeric web is positioned between each of the independently movable fingers.

18. The adjustable dispenser tip of claim 16 further comprising a collar arrangement at the tapered dispensing end portion for adjustment of the orifice area wherein the tapered tip end portion is positioned about and cooperative with the tapered dispensing end portion and rotatable with respect to the nozzle to traverse a length of the nozzle, the tapered tip end portion contacting each finger to independently urge each finger and adjust the orifice area.

19. The adjustable dispenser tip of claim 16 wherein the adjustable dispenser tip is connected to a caulk tube.

20. An adjustable dispenser tip comprising:

a nozzle forming a passage and having a plurality of fingers forming an orifice at a dispensing end portion of the nozzle, the fingers independently movable to adjust an area of the orifice; and an elastomeric web positioned with respect to the nozzle the elastomeric web positioned between each of the independently movable fingers and connecting adjacent fingers, the elastomeric web urging the fingers to adjust the area of the orifice.

21. The adjustable dispenser tip of claim 20 wherein the elastomeric web comprises a membrane positioned between the nozzle and the coupler, and covering the plurality of fingers.

* * * * *